United States Patent [19]

Caruso

[11] Patent Number: 4,590,687

[45] Date of Patent: May 27, 1986

[54] HAIR STYLING DIFFUSER

[76] Inventor: Richard Caruso, 7801 Montgomery Ave., Elkins Park, Pa. 19117

[21] Appl. No.: 720,432

[22] Filed: Apr. 5, 1985

[51] Int. Cl.[4] ..... F26B 19/00

[52] U.S. Cl. ..... 34/97; 34/101; 132/112; 219/367; 219/373

[58] Field of Search ..... 34/96, 97, 99, 101, 34/90, 91; 132/112; 219/367, 373; 239/289, 567, 602, DIG. 12

[56] References Cited

U.S. PATENT DOCUMENTS

| | | | |
|---|---|---|---|
| 3,491,774 | 1/1970 | Carbone | 219/373 |
| 4,076,032 | 2/1978 | Misercola | 34/97 |
| 4,230,279 | 10/1980 | Forberg | 34/97 |
| 4,391,047 | 7/1983 | Janssens et al. | 34/97 |
| 4,430,808 | 2/1984 | Toyomi et al. | 34/97 |

*Primary Examiner*—Albert J. Makay
*Assistant Examiner*—David Westphal
*Attorney, Agent, or Firm*—Seidel, Gonda, Goldhammer & Abbott

[57] ABSTRACT

A hair styling diffuser having a flexible pouch with a plurality of perforations, an open end and one or more slits in communication with the open end. The open end is adapted for releasable, rotatable engagement with a nozzle of a hair blower. A comb is affixed to the pouch by a strap which secures the pouch to the nozzle adjacent the pouch open end.

7 Claims, 5 Drawing Figures

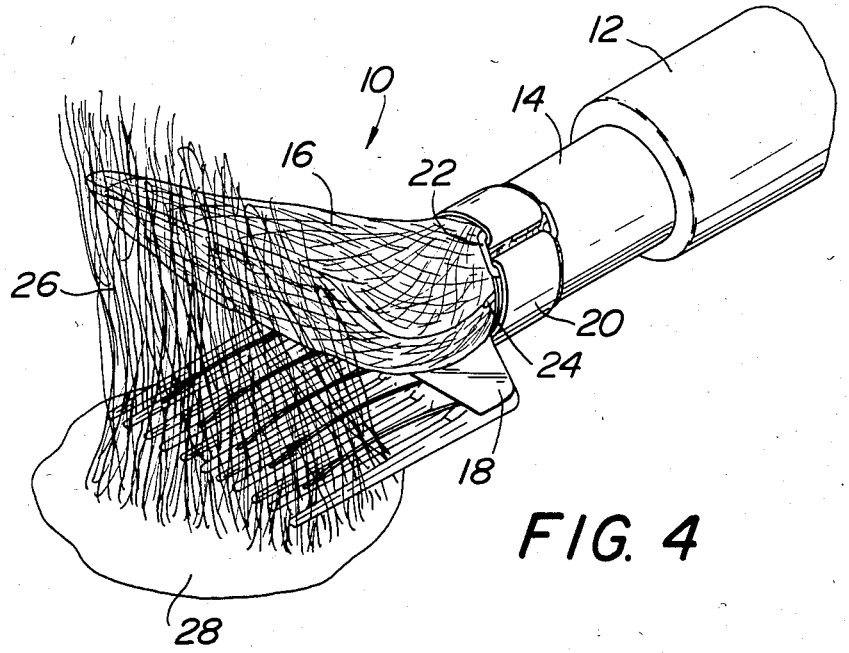
FIG. 4
FIG. 5
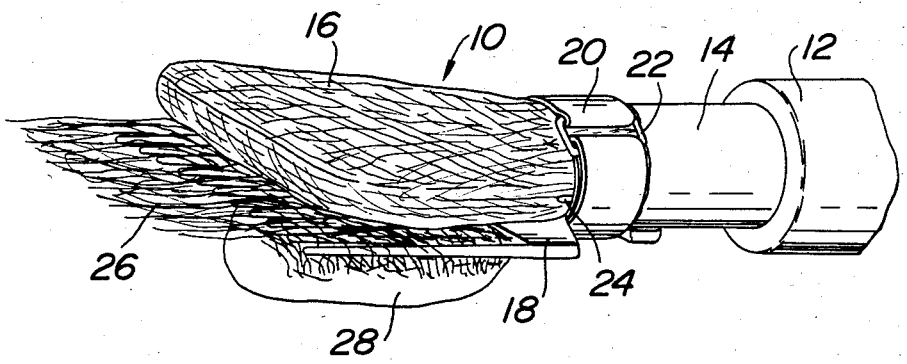

HAIR STYLING DIFFUSER

BACKGROUND OF THE INVENTION

Hair styling diffusers are known in the art which resemble a shower head attachment to a hair blower. Such diffusers have a foam nozzle through which the hot air from a hair blower may pass. These diffusers do not include combs, and generally direct the air flow in a straight ahead direction, i.e., parallel to the longitudinal axis of the blower nozzle. A comb attachment for a hair blower is also known in the art. The comb is secured to a rigid ring which mates telescopically with the blower nozzle and supports the comb. Again, air flows from the blower nozzle generally in a straight ahead direction unaffected by the comb.

SUMMARY OF THE INVENTION

The present invention is directed to a hair styling diffuser for attachment to a hair blower nozzle comprising a pouch having an open end adapted for engagement with the hair blower nozzle and having a plurality of perforations, a comb, and securing means disposed adjacent said open end and adapted for fastening said comb to said pouch and adapted for adjustably securing said pouch to the hair blower nozzle.

It is an object of this invention to provide a hair styling diffuser in which a comb is attached to the diffuser.

A further object of this invention is to provide a hair styling diffuser which requires only one hand to operate.

A still further object of this invention is to provide a hair styling diffuser which has a flexible pouch connected to a comb for wedging hair between the comb and pouch.

A still further object of this invention is to provide a hair styling diffuser which may be rotated 360° on the hair blower nozzle.

A still further object of this invention is to provide a hair styling diffuser through which hot air from the hair blower flows out of the diffuser in all directions.

A still further object of this invention is to provide a hair styling diffuser having a comb whereby hot air from the hair blower is prevented from contacting the scalp.

A still further object of this invention is to provide a hair styling diffuser which is flat and flexible for easy packing.

A still further object of this invention is to provide a hair styling diffuser which is small in size, easy to manufacture and inexpensive to produce.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 is an isometric view of the hair styling diffuser in use.

FIG. 5 is an isometric view of the hair styling diffuser in use.

DETAILED DESCRIPTION OF THE DRAWINGS

Figure 1:
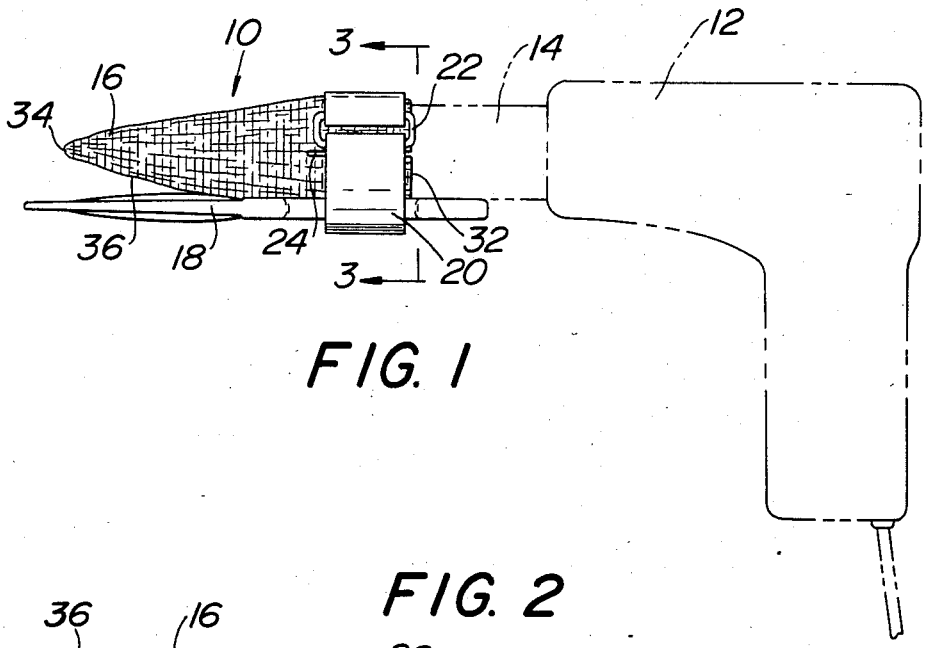
FIG. 1 is a side elevation of the hair styling diffuser secured to a hair blower shown in phantom.
Figure 2:
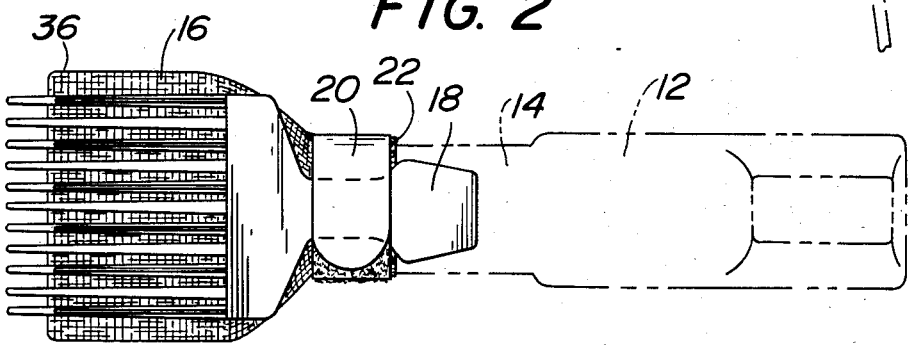
FIG. 2 is a bottom plan view showing the hair styling diffuser secured to a hair blower.

Referring to the drawings wherein like numerals indicate like elements, there is shown in FIG. 1 a hair styling diffuser 10 releasably secured to a nozzle 14 of any conventional hair blower 12. The hair styling diffuser 10 comprises, generally, a pouch 16, a comb 18 and a strap 20.

Figure 3:
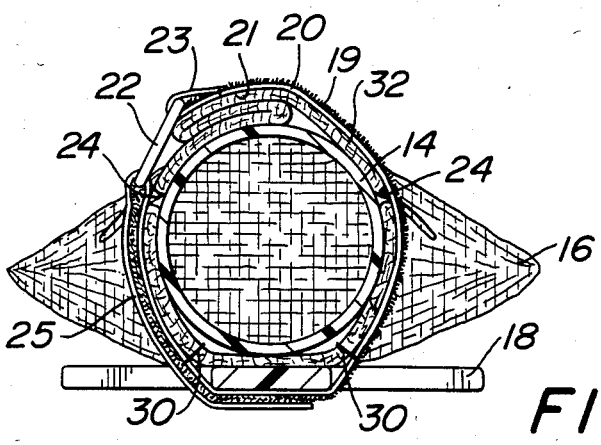
FIG. 3 is a cross section taken generally along lines 3—3 of FIG. 1.

Pouch 16 has a closed end 34 and an open end 32. Pouch 16 is made of a flexible loosely woven material having a plurality of perforations 36. Pouch 16 is fabricated of a fire retardant material and is preferably made of a synthetic material, such as nylon. Pouch 16 has at least one slit 24 and preferably two, see FIGS. 1 and 3. Slit 24 extends along a side of the pouch generally perpendicular to open end 32. Slit 24 allows the open end 32 of pouch 16 to be releasably secured to hair blower nozzles of varying sizes.

Comb 18 is secured to pouch 16 adjacent the pouch bottom panel via strap 20. See FIG. 3. Comb 18 has a plurality of teeth integral with a handle 34. Comb 18 is preferably made of a semi-rigid plastic material.

One side 19 of strap 20 is provided with Velcro (Trademark) fastener material. The other side 21 of strap 20 is in face contact with pouch 16 and is smooth. A buckle 22 is affixed to a first end portion 23 of strap 20. Another end portion 25 of strap 20 is provided with Velcro (Trademark) fastener material adapted to mate with the material on side 19. End portion 25 passes through the buckle 22 and is folded back upon itself whereby the Velcro materials on portion 25 and side 19 mate with one another to secure the pouch to nozzle 14. It should be appreciated that other fastener structures may be employed for securing the pouch to nozzle 14. For example, strap 20 may take the form of a conventional belt utilizing eyes and a clasp instead of Velcro (Trademark) fasteners to secure the pouch to the nozzle.

Strap 20 is stitched to the pouch bottom panel adjacent open end 32. The strap is adapted for securing the hair styling diffuser 10 to a variety of blower nozzle diameters. Comb 18 is captured between pouch 16 and strap 20 in a zone between stitches 30. See FIG. 3. Strap 20 and open end 32 are adjustable so as to accommodate any hair blower nozzle. Strap 20 secures the hair drying diffuser 10 on the hair blower nozzle 14, while allowing the diffuser 10 to be rotated 360° about nozzle 14. The diffuser 10 can therefore be rotated easily about the nozzle 14, using only one hand, for use on either the right or left side of the nozzle.

Referring to FIGS. 4 and 5, there is shown diffuser 10 in use. In FIG. 4, hair 26 on scalp 28 is drawn by comb 18 so as to stand on end as it is dried by blower 12. Pouch 16 flexes away from comb 18 allowing hot air from the blower 12 to diffuse through perforations 36 over the entire pouch surface area so as to gently dry hair 26. Additionally, as shown in FIG. 5, comb 18 may be manipulated to push hair 26 flat against scalp 28 while pouch 16 wedges hair 26 against the comb and air from hair blower 12 diffuses through perforations 36, primarily through the pouch bottom panel, to dry hair. The pouch 16 diffeses the air from the blower, thus preventing the air from pushing the hair out of the teeth of the comb. Therefore styling with the comb and drying with the blower are accomplished in one step.

It should be appreciated that the hair styling diffuser of the present invention may easily be folded flat for travel or shipment because the pouch and strap are lightweight and flexible and easily folded back upon themselves.

The present invention may be embodied in other specific forms without departing from the spirit or essential attributes thereof and, accordingly, reference should be made to the appended claims, rather than the foregoing specification, as indicating the scope of the invention.

I claim:

1. A hair styling diffuser for attachment to a hair blower comprising:

a flexible pouch being free of integral supporting structure and having a single open end adapted for telescoping engagement with a hair blower nozzle, said pouch having a plurality of perforations therein;

means for combing; and securing means adjacent said pouch open end and adapted for securing said means for combing to said pouch and said pouch to the nozzle of said hair blower.

2. The hair styling diffuser according to claim 1 wherein said pouch is provided with at least one slit in communication with said open end whereby a flow area of said open end is adjustable.

3. The hair styling diffuser according to claim 2 wherein said pouch has at least two such slits.

4. The hair styling diffuser according to claim 1 wherein said securing means comprises a strap and material on said strap for fastening said strap on said nozzle.

5. The hair styling diffuser according to claim 4 wherein said material includes Velcro fasteners.

6. The hair styling diffuser according to claim 1 wherein said securing means comprises a belt.

7. A hair styling diffuser for attachment to a hair blower nozzle comprising:

a flexible pouch being free of internal supporting structure and having a single open end adapted for releasable, rotatable engagement with the hair blower nozzle, said pouch having a plurality of perforations therein;

means for combing;

a strap adjacent said open end and adapted for securing said means for combing to said pouch and said pouch to said hair blower nozzle, said strap having material provided with Velcro fasteners and a buckle affixed thereto such that the strap material can be folded back through the buckle and on itself with the Velcro fasteners in locking engagement.

* * * * *